United States Patent [19]

Vogler et al.

[11] 4,196,326

[45] Apr. 1, 1980

[54] PRESSURE RESPONSIVE ELECTRIC SWITCH, PARTICULARLY AN EVAPORATOR THERMOSTAT FOR REFRIGERATORS

[75] Inventors: Jes Vogler, Sonderborg; Peter R. Hanson, Nordborg; Niels P. Thorsen, Sonderborg, all of Denmark

[73] Assignee: Danfoss A/S, Nordborg, Denmark

[21] Appl. No.: 950,624

[22] Filed: Oct. 12, 1978

[30] Foreign Application Priority Data

Oct. 17, 1977 [DE] Fed. Rep. of Germany ..... 2746627

[51] Int. Cl.[2] ..... H01H 35/24

[52] U.S. Cl. ..... 200/81 R; 200/83 C; 200/83 SA

[58] Field of Search ..... 200/81 R, 81.5, 83 R, 200/83 C, 83 S, 83 SA, 82 R, 82 C; 337/117

[56] References Cited

U.S. PATENT DOCUMENTS

| | | | |
|---|---|---|---|
| 2,480,538 | 8/1949 | Barr | 200/83 SA |
| 3,256,398 | 6/1966 | Snider | 200/81 R |
| 4,082,929 | 4/1978 | Thorsen | 200/81 R |

*Primary Examiner*—Gerald P. Tolin

*Attorney, Agent, or Firm*—Wayne B. Easton

[57] ABSTRACT

The invention relates to a pressure responsive electric switch assembly of a type used as evaporator thermostats for refrigerators. In this unit an actuating element for operating a switch is held in equilibrium by two springs acting in opposition to a bellows which is connected to a temperature sensor capsule containing a liquid-vapor filling. An abutment arrangement is provided for the springs so that, despite a constantly rising pressure in the bellows, the actuating element operated by the bellows has a zero or null displacement range which corresponds to a substantial intermediate pressure range to which the bellows is subjected by the temperature sensor. As there is no movement by the actuating element in this intermediate range, there is an avoidance of wear which would otherwise be caused by this movement.

3 Claims, 2 Drawing Figures

Figure 1:
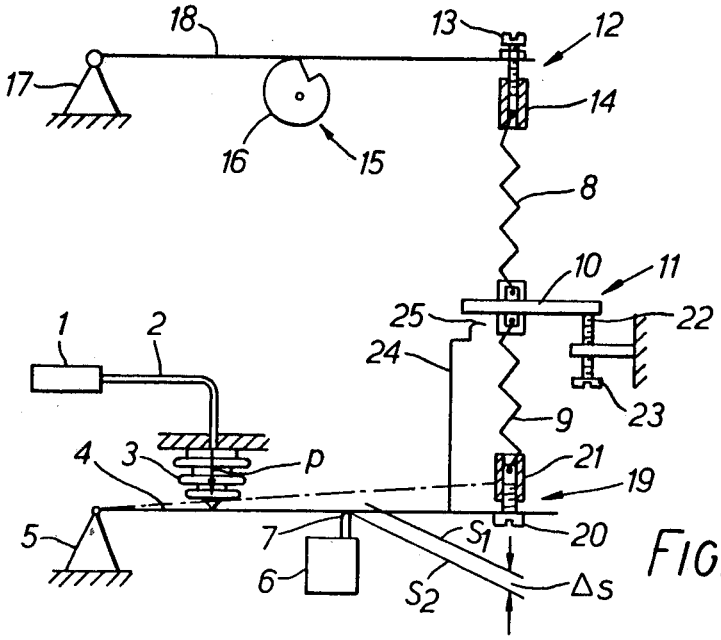

PRESSURE RESPONSIVE ELECTRIC SWITCH, PARTICULARLY AN EVAPORATOR THERMOSTAT FOR REFRIGERATORS

The invention relates to a pressure responsive electric switch, particularly an evaporator thermostat for refrigerators, of which the actuating element is held in equilibrium under the influence of two springs and a pressure generator, e.g. the operating bellows of a thermostatic system with a liquid-vapour filling, and effects switching-over in the one direction in a first switching position of lower pressure and in the other direction in a second switching position of higher pressure, the first spring being disposed between a setting device to fix the first switching position and a coupling station and the second spring being disposed between said coupling station and the actuating element, wherein the coupling station co-operates with a stationary first abutment when the pressure is higher than a first value.

In known electric switches which switch over at two different pressure values and use two springs for this purpose, of which one can be rendered ineffective, the position of the actuating element is changed for each pressure variation in the pressure generator. This continuous motion results in wear, particularly at the bearing points, and thus to a reduction in the accuracy in the course of its life.

Numerous constructional principles are available for such switches. According to one previous suggestion of the aforementioned kind, the two springs are connected in series in the region of the first switching position. Since the changes in length of the two springs are cumulative, one obtains a comparatively flat characteristic spring curve in the force-displacement diagram, which permits very accurate setting of the pressure value at which switching-over is to take place. In the region of the other switching position, the one spring is rendered ineffective by the stationary abutment. The now solely effective other spring gives a comparatively steep spring curve which makes it more difficult to achieve an accurate setting of the pressure value at which the second switching-over is to take place.

The invention is based on the problem of providing a pressure responsive electric switch in which there is less wear and which is therefore more accurate over a longer period.

To solve this problem, a switch of the aforementioned kind is modified in that a second abutment at the actuating element co-operates with the coupling station when the pressure is lower than a second value higher than the first value.

In this construction, the actuating element remains still during part of the pressure change, preferably even during the greater part, because the coupling station lies against the stationary first abutment on the one side and on the other side is held by the bias of the second spring against the second abutment provided at the actuating element. During standstill there is no wear. The actuating element will move only when the pressure of the pressure generator falls below the predetermined first value or exceeds the predetermined upper value. In the first case only the first spring is effective; in the second case only the second spring is effective. In both cases the displacement of the actuating element can be selected to be relatively small and limited by abutments or the like. The amount of wear is correspondingly small.

Since the force-displacement diagram exhibits a jump, a flat characteristic spring curve can also be provided in the region of the second switching position. The term 'flat' means that the inclination of the characteristic curve is less than the inclination of the connecting line between the two end points of the characteristic curve. Consequently, accurate setting or adjustment of the desired pressure value can be effected notonly in the first switching position but also in the second switching position. Any the setting scales can be widely spread.

Another advantage is that only one spring is effective at each pressure value at which switching-over is to take place, which corresponds to the switching on and switching off temperature in the case of a thermostat. One can therefore also measure the switching pressureor the switching temperature with these springs.

It is of particular advantage if the characteristic curve of the second spring has a flat course similar to that of the first spring. Especially in the case of a thermostat with a liquid-vapour filling, it is desirable for the purpose of adapting to the curved vapour pressure curve to have a characteristic curve for the first spring that is as flat as possible. If the same applies to the characteristic curve of the second spring, one obtains the largest possible jump in the combined spring characteristic, i.e. the longest possible standstill period for the actuating element.

Adjusting means are favourable for setting the bias of the second spring when the coupling station abuts the second abutment. By changing the bias one changes the pressure at which there is switching-over to the second switching position. These adjusting means can for example displace the second abutment in relation to the actuating element. However, it is particularly simple if they comprise a set screw at the actuating element and a suspension nut engageable therewith for the second spring.

Figure 2:
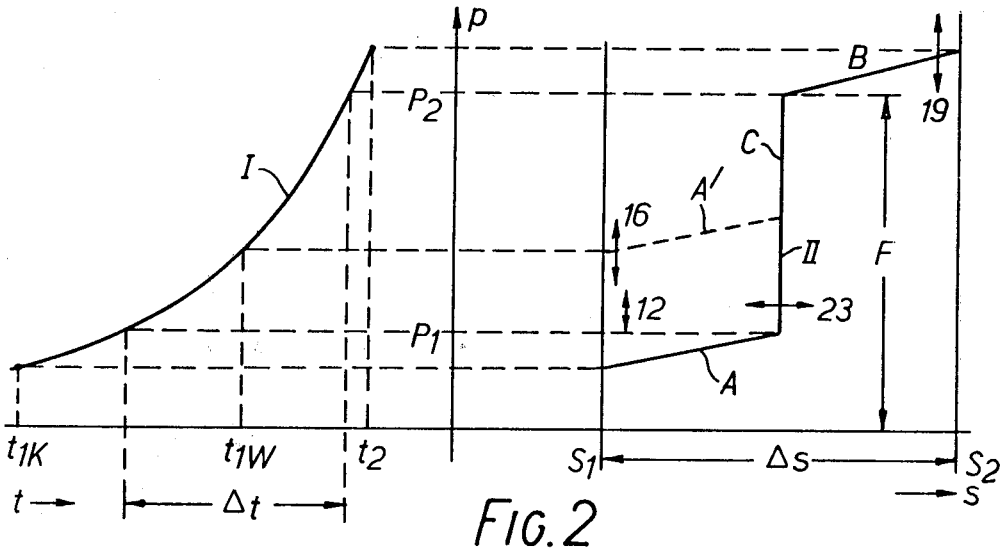

The invention will now be described in more detail with reference to an example illustrated in the drawing, wherein:

FIG. 1 diagrammatically shows a vapour thermostat constructed according to the invention, and FIG. 2 is an associated diagram showing the relationship between the measured temperature t, the pressure p that occur and the displacement s of the actuating element.

A sensor 1 with a liquid-vapour filling is connected by a capillary tube 2 to an operating element 3. The vapour pressure effective inside it gives rise to a force p which acts on an actuating element 4 in the form of a swing arm rotatable about a hinge 5. The swing arm acts on a microswitch 6 of which the rod 7 defines in the dotted position the switching position $S_1$ of lower pressure and, after traversing the switching distance $A_s$, defines the switching position $S_2$ of higher pressure in the position shown in full lines.

A selected one of two springs 8 and 9 also acts on the actuating element 4 against the force P. The first spring 8 extends between a coupling member 10 which defines a coupling station 11 and an adjusting device 12 consisting of a set screw 13 and an associated nut 14 to the end of which the spring 8 is secured. The adjusting device is seated at the end of a setting device 15 consisting of a cam plate 16 and a swing arm 18 pivotable about a stationary bearing 17. The second spring 9 extends between the coupling member 10 and an adjusting device 19 comprising a set screw 20 engaging through the actuating element 4 and an associated nut 21 to which the spring 9 is secured.

The coupling member 10 co-operates with a stationary first abutment 22, here formed by a set screw 23, when the pressure p exceeds a predetermined first value $p_1$. The actuating element 4 is provided with a rod 24 having a second abutment 25 against which the coupling member 10 lies when the pressure p falls below a predetermined second pressure $p_2$.

This leads to the following manner of operation to be described with reference to FIG. 2. A vapour pressure curve I shows the relationship between the temperature t measured by the sensor 1 and the pressure p obtaining in the operating element 3. The force-displacement diagram shows a combined characteristic spring curve II consisting of three sections, namely two flat sections A and B and a jump C. The section A is dependent only on the first spring 8 and the section B only on the spring 9. Both springs are selected so that they have the illustrated flat course of the characteristic spring curve. The jump C is obtained because the spring 8 is rendered ineffective by the first abutment 22 and the spring 9 has a bias F corresponding to the pressure $p_2$. By regarding both portions of the diagram, one will see that the first switching-over of the microswitch 6 (switching off in the case of a refrigerator thermostat) takes place when the measured temperature falls below the value $t_{lk}$ and that the second switching over (switching on in the case of a refrigerator thermostat) takes place when the measured temperature exceeds the value $t_2$.

Since the actuating element 4 moves only during pressure variations corresponding to section A and B, one obtains a comparatively large temperature range $\Delta t$ within which the actuating element is stationary. This can, as in the present example, amount to the larger part between the two limiting temperatures $t_{lk}$ and $t_2$. Movement is correspondingly small and so is the wear of the appliance.

By adjusting the cam plate 16 the section A can be displaced within a predetermined range, namely up to the position A'. In this way one sets a different lower temperature limiting value $t_{lw}$. By adjusting the adjusting device 12 one displaces the entire range within which section A can be adjusted.

By adjusting the adjusting device 19 one changes the bias F and thus the upper end of section C, i.e. section B is displaced parallel to itself. This enables the upper temperature $t_2$ to be set. By adjusting the abutment 23 one displaces the position of the jump in the characteristic spring curve to the left or to the right.

Since the two sections A and B are very flat (in comparison with a direct connecting line between the two end points), a very fine setting or adjustment is possible. Ageing and the like similarly lead to only very slightly different response values.

Springs 8 and 9 are here shown as tension springs. However, they can also be compression springs or one can be a compression spring and the other a tension spring. Further, other spring constructions are also feasible, e.g. leaf springs.

What is claimed is:

1. A pressure responsive electric switch assembly, comprising, an actuating element mounted for displacement between first and second extreme positions, switch means actuated by said actuating element having on and off states corresponding to said positions, pressure responsive motor means responsive to applied pressures biasing said actuating element in the one direction, displacement control means for controlling the displacement of said actuating element during a constantly increasing motive pressure applied to said motor means to provide a substantially null displacement for a substantial intermediate pressure range between upper and lower pressure ranges, said displacement control means including first and second series connected spring means for biasing said actuating element in the off direction and a coupling member connecting said first and second spring means, anchor means for holding one end of said first spring means in a relatively fixed position, means attaching one end of said second spring means to said actuating element, stationary first abutment means for arresting movement of said coupling member after a predetermined displacement at a position corresponding to a predetermined lower pressure applied to said motor means, second abutment means attached to and carried by said actuating element for engagement with said coupling member when said applied pressure is lower than a predetermined higher pressure applied to said motor means, said first and second abutment means being effective to prevent said first and second spring means from deforming during said intermediate pressure range.

2. A switch assembly according to claim 1 wherein the characteristic curves of said first and second spring means are relatively flat.

3. A switch assembly according to claim 1 including adjusting means for setting the respective biases of said first and second spring means.

* * * * *